US009789618B2

(12) United States Patent
Bozikis et al.

(10) Patent No.: US 9,789,618 B2
(45) Date of Patent: Oct. 17, 2017

(54) RAZOR HEAD HAVING A LOW SHAVING ANGLE

(71) Applicant: BIC Violex SA, Agiou Athanasiou (GR)

(72) Inventors: Ioannis Bozikis, Nea Kypseli (GR); Michalis Karoussis, Neo Iraklio (GR)

(73) Assignee: BIC VIOLEX S.A., Anixi (GR)

( * ) Notice: Subject to any disclaimer, the term of this patent is extended or adjusted under 35 U.S.C. 154(b) by 224 days.

(21) Appl. No.: 14/350,295

(22) PCT Filed: Oct. 8, 2012

(86) PCT No.: PCT/EP2012/069885

§ 371 (c)(1),
(2) Date: Apr. 7, 2014

(87) PCT Pub. No.: WO2013/050608

PCT Pub. Date: Apr. 11, 2013

(65) Prior Publication Data

US 2014/0283387 A1 Sep. 25, 2014

(30) Foreign Application Priority Data

Oct. 6, 2011 (WO) ..... PCT/EP2011/067451

(51) Int. Cl.
*B26B 21/40* (2006.01)
*B26B 21/14* (2006.01)
(Continued)

(52) U.S. Cl.
CPC ..... *B26B 21/14* (2013.01); *B26B 21/4031* (2013.01); *B26B 21/4068* (2013.01);
(Continued)

(58) Field of Classification Search
CPC . B26B 21/14; B26B 21/4031; B26B 21/4068; B26D 21/565; B26D 21/58; Y10T 225/10
(Continued)

(56) References Cited

U.S. PATENT DOCUMENTS 4,498,235 A 2/1985 Jacobson
5,313,706 A * 5/1994 Motta ..... B26B 21/227 30/47
(Continued)

FOREIGN PATENT DOCUMENTS

JP 2009-540885 A 11/2009
WO WO 2007-147420 A1 12/2007
(Continued)

OTHER PUBLICATIONS

International Search Report for PCT/EP2012/069885.
Japanese Office Action dated May 23, 2016 for Japanese Application No. 2014-533942.

*Primary Examiner* — Omar Flores Sanchez
(74) *Attorney, Agent, or Firm* — Polsinelli PC

(57) ABSTRACT

A razor head that includes a housing having a top face defining a shaving window delimited by a front guard and a rear cap together defining a tangent plane, at least one rigid cutting member, each freely mounted in the housing, and having a cutting edge portion extending along a cutting edge portion axis, and having a cutting edge accessible through the shaving window, a guided portion extending along a guided portion axis, and a bent portion intermediate the cutting edge portion and the guided portion. An angle measured between the cutting edge axis and the tangent plane is between 5° and 30°.

16 Claims, 7 Drawing Sheets

(51) Int. Cl.
*B26B 21/56* (2006.01)
*B26B 21/58* (2006.01)

(52) U.S. Cl.
CPC ..... *B26B 21/565* (2013.01); *B26B 21/58* (2013.01); *Y10T 225/10* (2015.04)

(58) Field of Classification Search
USPC ..... 30/50, 81, 346.57
See application file for complete search history.

(56) References Cited

U.S. PATENT DOCUMENTS

| | | | | |
|---|---|---|---|---|
| 5,533,263 | A * | 7/1996 | Gilder | B26B 21/225 30/527 |
| 2003/0217469 | A1 | 11/2003 | Coffin | |
| 2005/0223568 | A1 | 10/2005 | Walker et al. | |
| 2007/0234576 | A1 | 10/2007 | Masek et al. | |
| 2015/0321366 | A1 * | 11/2015 | Papadopoulos-Papageorgis | B26B 21/222 30/532 |
| 2015/0328788 | A1 * | 11/2015 | Ren | B26B 21/222 30/526 |

FOREIGN PATENT DOCUMENTS

| | | |
|---|---|---|
| WO | WO 2009-057071 A1 | 5/2009 |
| WO | WO 2009/137389 | 11/2009 |
| WO | WO 2011/062881 | 5/2011 |

* cited by examiner

RAZOR HEAD HAVING A LOW SHAVING ANGLE

CROSS REFERENCE TO RELATED APPLICATION

This application is a national stage application of International Application No. PCT/EP2012/069885, filed on Oct. 8, 2012, which claims the benefit of International Application No. PCT/EP2011/067451 filed on Oct. 6, 2011, the entire contents of both applications being incorporated herein by reference.

FIELD OF THE INVENTION

The embodiments of the present invention relate to a razor head with blades having a low shaving angle.

BACKGROUND OF THE INVENTION

In the field of mechanical wet shavers, it has long been provided with a shaver which has a head receiving one or more cutting members.

Recently, the trend has been to provide shavers with a multiplicity of blades with the goal of increasing the closeness of the shave that is achieved while also still providing a comfortable shaving experience. Shavers currently on the market strive to achieve an optimum balance between efficiency, closeness and comfort of a shave. Achieving this balance is made difficult because of many different types of hair, different shaving habits and variables of a razor cartridge that influence the shaving characteristics of a safety razor.

Efforts have been made to arrive at an optimal angle for the blades relative to a blade plane to achieve a shaving angle which provides efficiency, closeness and comfort.

SUMMARY OF THE EMBODIMENTS OF THE PRESENT INVENTION

An embodiment of the present invention includes a razor head that includes a housing having a top face defining a shaving window delimited by a front guard and a rear cap together defining a tangent plane, at least one rigid cutting member, each freely mounted in the housing, and having a cutting edge portion extending along a cutting edge portion axis, and having a cutting edge accessible through the shaving window, a guided portion extending along a guided portion axis, and a bent portion intermediate the cutting edge portion and the guided portion, where an angle measured between the cutting edge axis and the tangent plane is between 5° and 30°.

Surprisingly, tests have shown that, by providing the shaving angle in that range, optimal shaving performance could be achieved. Indeed, a low shaving angle allows the blade edges to come in contact with the hair closer to being parallel with the skin, increases the shaving comfort, and reduces skin irritation.

BRIEF DESCRIPTION OF THE DRAWINGS

Other characteristics and advantages of the embodiments of the present invention will readily appear from the following description of some of its embodiments, provided as non-limitative examples, and of the accompanying drawings.

On the drawings.

On the different Figures, the same reference signs designate like or similar elements.

DETAILED DESCRIPTION

Figure 1:
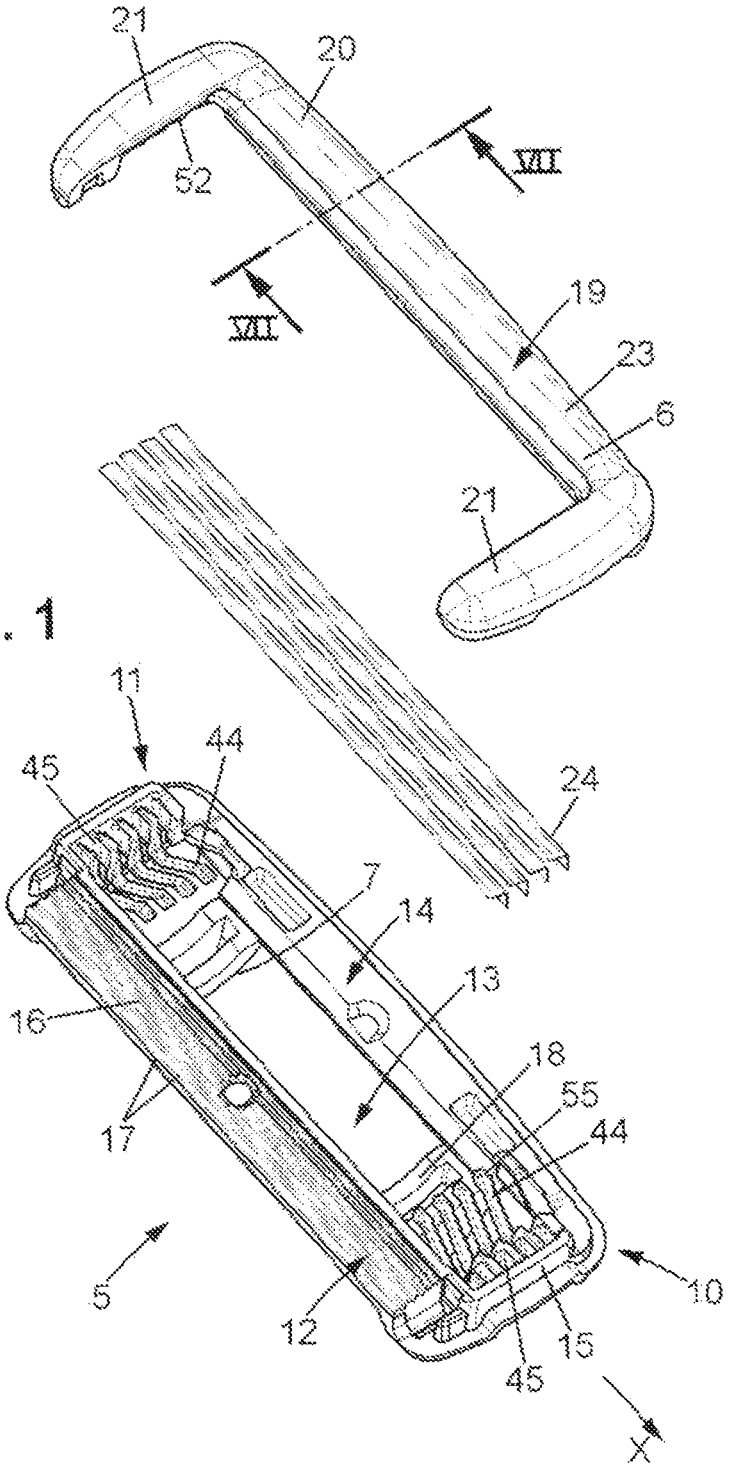
FIG. 1 is an exploded perspective view of a razor head.

FIG. 1 shows a head 5 of a safety razor (also called wet shaver), a shaver the blades of which are not driven by a motor relative to the blade unit.

The shaving head 5 is to be borne by a handle extending in a longitudinal direction between a proximal portion and a distal portion bearing the blade unit 5 or shaving head. The longitudinal direction may be curved or include one or several straight portions.

The blade unit 5 includes an upper face 6 defining a shaving window, and equipped with one or several cutting members and a lower face 7 which is to be connected to the distal portion of the handle by a connection mechanism. The connection mechanism may for instance enable the blade unit 5 to pivot relative to a pivot axis X which is substantially perpendicular to the longitudinal direction. The connection mechanism may further enable to selectively release the blade unit for the purpose of exchanging blade units. One particular example of connection mechanism usable in the present invention is described in document WO-A-2006/027018, which is hereby incorporated by reference in its entirety for all purposes.

The blade unit 5 includes a frame 10 which is made solely of synthetic materials, i.e. thermoplastic materials (polystyrene or ABS, for example) and elastomeric materials.

More precisely, the frame 10 includes a plastic platform member 11 connected to the handle by the connection mechanism and having:

- a guard bar 12 extending parallel to the pivot axis X,
- a blade receiving section 13 situated rearward of the guard 12 in the direction of shaving,
- a rear portion 14 extending parallel to the pivot axis X and situated rearward of the blade receiving section 13 in the direction of shaving,
- and two side portions 15 joining the longitudinal ends of the guard bar 12 and of the rear portion 14 together.

In the example shown in the figures, the guard bar 12 is covered by an elastomeric layer 16 forming a plurality of fins 17 extending parallel to the pivot axis X.

Further, in this particular example, the underside of the platform member 11 includes two shell bearings 18 which belong to the connection mechanism and which may be for example as described in the above-mentioned document WO-A-2006/027018.

In an embodiment, and such as represented on the drawings, the frame 10 further includes a plastic cover 19 having a top face and an opposite bottom face, which faces the top face of the components of the platform 11. The cover 19 exhibits a general U shape, with a cap portion 20 partially covering the rear portion 14 of the platform and two side members 21 covering the two side members 15 of the platform. In this embodiment, the cover 19 does not cover the guard bar 12 of the platform.

The cap portion 20 of the cover 19 may include a lubricating strip 23 which is oriented upward and comes into contact with the skin of the user during shaving. This lubricating strip may be formed for instance by co-injection with the rest of the cover. The cover 19 is assembled to the platform 11 by any suitable means, such as, for example, by ultra-sonic welding, as explained in WO 2010/06,654, hereby incorporated here in its entirety for all purposes.

The present description of a housing is exemplary only.

At least one cutting member 24 is movably mounted in the blade receiving section 13 of the platform. The blade receiving section 13 may include several cutting members 24.

Figure 4:
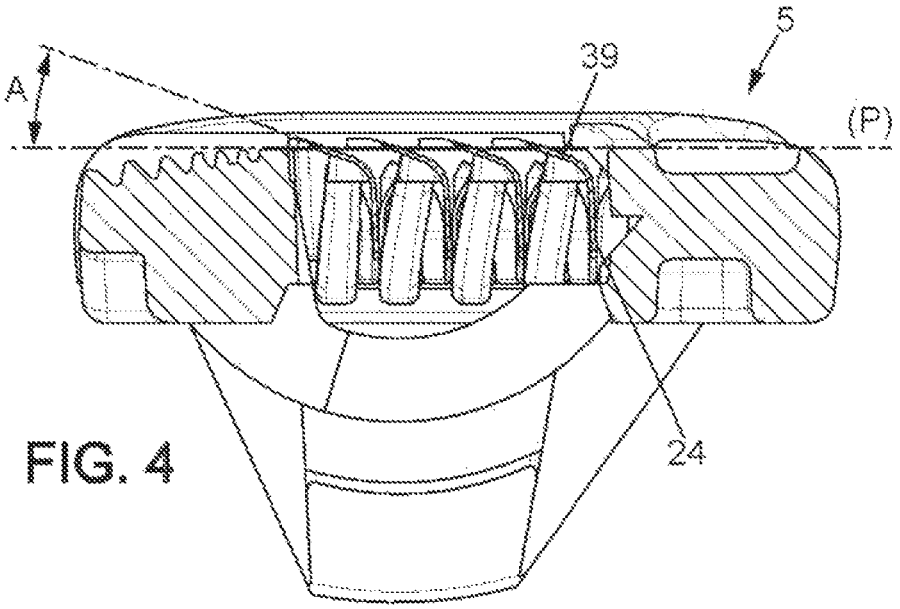
FIG. 4 is a schematic sectional view along line VII-VII on FIG. 1 of a razor head according to the first embodiment.

In a first embodiment, and such as represented FIGS. 1 and 4 of the drawings, the blade receiving section includes four cutting members.

Each cutting member 24 is made of a blade which is integrally formed from a flat steel strip.

In particular, one may use a martensitic stainless steel with the following composition (in weight):

Carbon: between 0.62% and 0.75%,

Chromium: between 12.7% and 13.7%,

Manganese: between 0.45% and 0.75%,

Silicon: between 0.20% and 0.50%,

Iron: Balance

Such an alloy has no more than traces of other components, and notably no more than traces of Molybdenum.

Figure 2A:
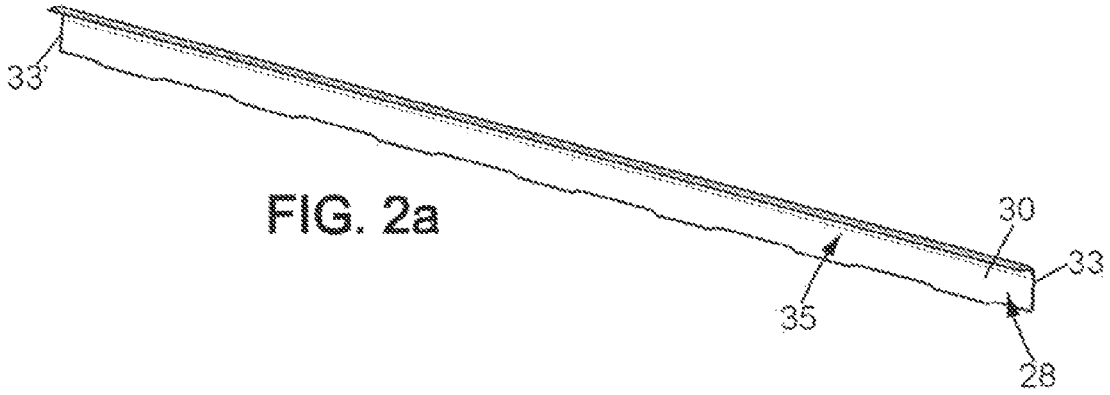
FIGS. 2*a* and 2*b* are two opposed perspective views of a blade of a razor head according to a first embodiment.
Figure 2B:
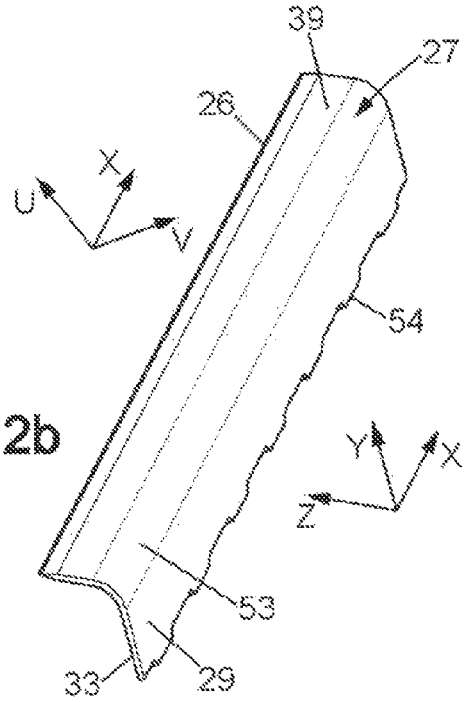
Figure 3:
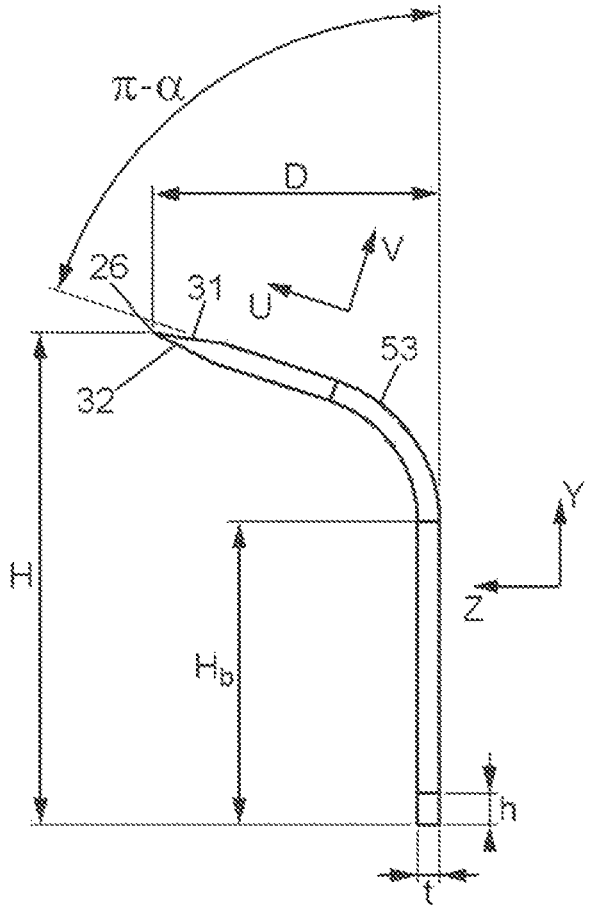
FIG. 3 is a lateral view of the blade of FIGS. 2*a* and 2*b*.

The cutting members are L-shaped such as represented on FIGS. 2*a*, 2*b* and 3, for example. The cutting members have a cutting edge portion 26, a guided portion 35, and a bent portion 53 is intermediate the cutting edge portion and the guided portion. The cutting member (or razor blade) has, opposed to the cutting edge 26, a rear edge 54.

Each blade 24 extends longitudinally, parallel to the pivot axis X, between two lateral sides 33, 33'. For example, the lateral sides are straight.

Each blade 24 has a bent profile including:

- a substantially flat base portion 35 (for example substantially perpendicular to the tangent plane (also called shaving plane)) having a periodically serrated edge 54,
- a substantially flat cutting edge portion 39 comprising the cutting edge 26,
- a bent portion 53 extending between the base portion and the cutting edge portion. The bent portion has a concave face 28 and an opposed convex face 27. The face of the blade having the concave face is called inner face, and the other one the outer face. Such integrally formed blades are also called bent blades.

When the blade is mounted to slide in the head, the base portion is also sometimes called "guided portion".

The cutting edge 26 is oriented forward in the direction of shaving. The cutting edge 26 is accessible through the shaving window of the blade-receiving section 13, to cut hair.

The cutting edge portion 39 extends along a cutting edge portion axis. Advantageously, the cutting edge portion axis of all cutting member are positioned parallel to each other. The frame 10 defines a tangent plane (or shaving plane) which corresponds to the plane tangential to the skin contacting surfaces of the frame behind and at front of the cutting edges. The cutting edge of the blades extends below the tangent plane P (see FIG. 4). In other words, the blades have a positive exposure.

As previously the, each bent blade 25 has an outer face 27 oriented towards the skin to be shaved and an opposed inner face 28. The outer and inner faces 27, 28 of the blade include respectively two parallel main surfaces 29, 30 and two tapered facets 31, 32 which taper towards the cutting edge 26. The two tapered facets form an edge angle, and the bisecting line of the edge angle is the cutting edge portion axis.

As shown in FIG. 1, each cutting member 24 is borne by two elastic fingers 44 which are molded as a single piece with the platform 11 and which extend towards each other and upwardly from both side members 15 of the platform. For example, all the fingers 44 extending from a given side member are identical. Besides, as shown in FIG. 2, the base portions 35 of the cutting members are slidingly guided in slots 45 provided in the inner face of each side member 15 of the platform. The slots are, for example, substantially perpendicular to the shaving plane.

The cutting members 24 are elastically biased by the elastic arms 44 toward a nominal position. In this nominal position, the outer faces 27 of the cutting member, and more precisely the cutting edge portion, at each lateral end of the cutting member, bear against corresponding upper stop portions 52 which are for example provided on the bottom stopping face of each side member 21 of the cover, the side member 21 covering the slots 45. In the nominal position an angle (also called shaving angle) may be measured between the cutting edge axis and the tangent plane defined by the front guard and the rear cap above-mentioned.

For movable bent blades of the type described above, a shaving angle of between 5° and 30° seemed to provide good results as described below. Better results are expected for a shaving angle between 12° and 27°, notably between 12° and 19°, and preferably between 12° and 18°.

Since the cutting edge portion axis of all cutting member are positioned parallel to each other, the angle between the cutting edge axis and the tangent plane is the same for all blades.

The guiding slots 45 define a direction Y for the razor head. The direction Z is the normal to the X-Y plane. The base portion 35 extends in a base portion plane. The base portion axis is the main axis of the base portion other than its profile axis, i.e. other than the X axis. In the present embodiment, it is the Y axis. In other words, the main axis along which the base portion extends is the same as the axis defined by the slots 45 in the razor head.

The cutting edge portion 39 extends in a cutting edge portion plane. The cutting edge portion axis is the main axis of the cutting edge portion other than its profile axis, i.e. other than the X axis. In the present embodiment, it is a U axis. In other words, the cutting edge portion axis extends in an X-U plane. A V axis is defined normal to the X-U plane.

Figure 5A:
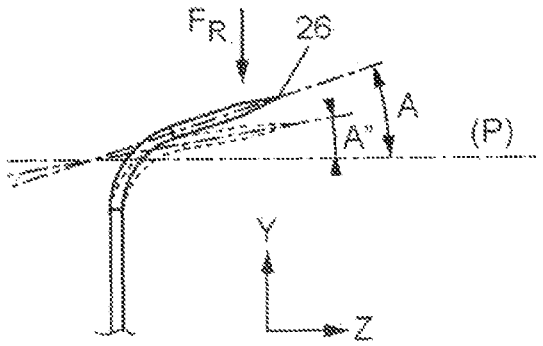
FIGS. 5*a* and 5*b* are schematic views of the blade of FIG. 3 in different positions.

To achieve the shaving, the user has to make into contact the razor head with his skin. As shown on FIG. 5*a*, the angle A" measured between the cutting edge axis and the tangent plane when the razor head is contacting the skin of the user and before any movement is different than the angle A measured between the cutting edge axis and the tangent plane in the nominal position. Indeed, a force will be applied to the cutting member by the user, along a direction Fr (see FIG. 4) which is sensibly normal to the tangent plane P (In other words, the force F is applied sensibly in the Y direction at approximately ±5°) to achieve the contact between the skin and the cutting members.

Upon shaving, a force Fs will also be applied to the cutting member along a direction Fs which is sensibly parallel to the tangent plane P. The cutting members are guided for movement in a direction perpendicular to the tangent plane through the slots 45.

The shape of the bent blades and their placement inside the slot 45 allows a degree of rotational movement of the blades with regard to the frame of the razor head. In other words, the whole blade rotates in the slot when there is force acting on the hair during hair or skin contact (i.e. there is a deformation of the slots 45 receiving the blades). The rotation tends to increase the shaving angle.

Moreover, the shape of the bent blades and their placement inside the slot 45 allows also a deflection movement of the blade (i.e. an elastic deformation of the blade itsef). More precisely, the shape of the bent blades and their placement inside the slot 45 allows a movement of the cutting edge portion with regard to the guided portion, such as shown on FIG. 5*b*. More precisely, under a force applied along the direction Fr, the elastic fingers 44 retract into slot 45 and the blade has a movement of translation toward the bottom of the frame 10 through its guided portion and the slots 45. At the same time, the blade rotates in the slot and there is a deflection movement of the blades, and more precisely the bent portion moves and the angle between the cutting edge portion and the guided portion increase.

Since the force applied to the cutting member is different in a position when the head contact the skin without moving (also called rest-position) and a movable position during shaving (also called shaving position), the rotation of the cutting edge portion is different, and therefore also the angle. In the shaving position, the rotation increases the nominal shaving angle.

Figure 5B:
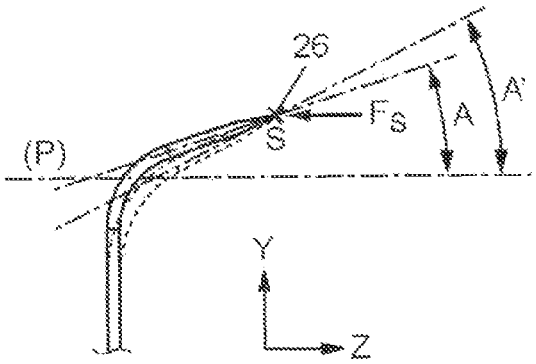

More precisely on FIG. 5*b* the S point represents the contact point between the skin and the cutting edge. The cutting member with a full line is the cutting member in the nominal position whereas the cutting member with dashed point represents the cutting member in the shaving position. In the nominal position, the angle A between the cutting edge axis and the tangent plane P is lower than the angle A' between the cutting edge axis and the tangent plane P in the shaving position. A direct relation exists between the angle A in the nominal position and the angle A' in the shaving position which depends on the force exerted by the user and on the elasticity degree of the elastic fingers. Therefore, a low shaving angle in the nominal position allows a low shaving angle in the rest and shaving positions which permits optimal shaving performances as described below. According to tests the optimal shaving angle depends on the shape of the blade and is, for bent blades between 5° and 30°, and more precisely between 12° and 27°, between 12° and 19°, or between 12° and 18° as previously noted.

As aforementioned, a low shaving angle in the range above-described allows a better blade edge penetration and usage convenience. The cutting edge portion of a blade with a shaving angle being under 30° comes in contact to the hair sensibly parallel to the skin. The hair cutting action is mainly performed by the cutting edge, i.e. the sharpest point of the blade. The resistance to cutting is therefore lower which means a better usage convenience for the user.

Figure 10A:
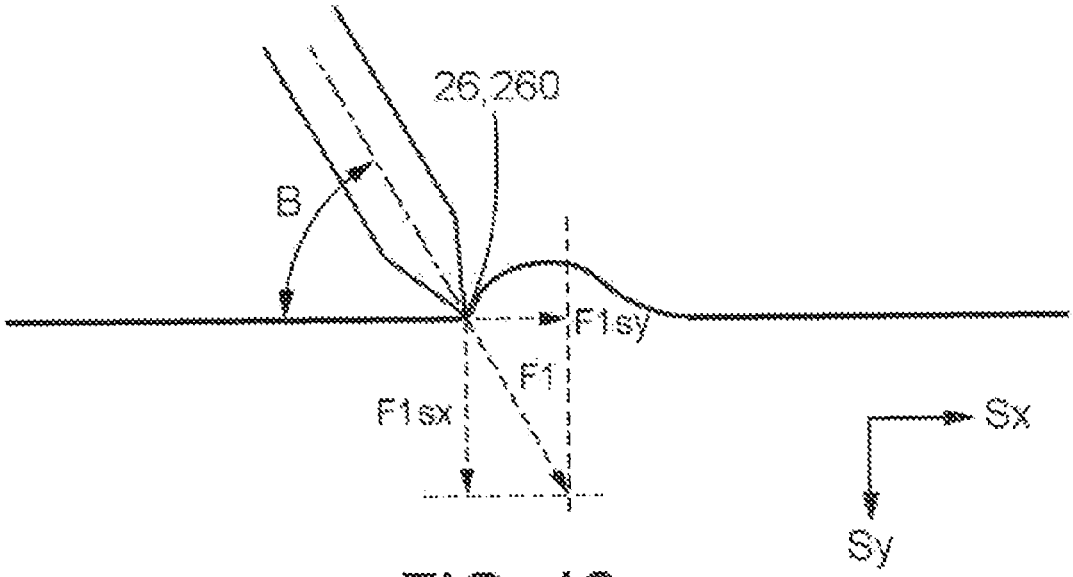
FIGS. 10*a* and 10*b* are schematic views of a blade contacting the skin of a user with different shaving angles.
Figure 10B:
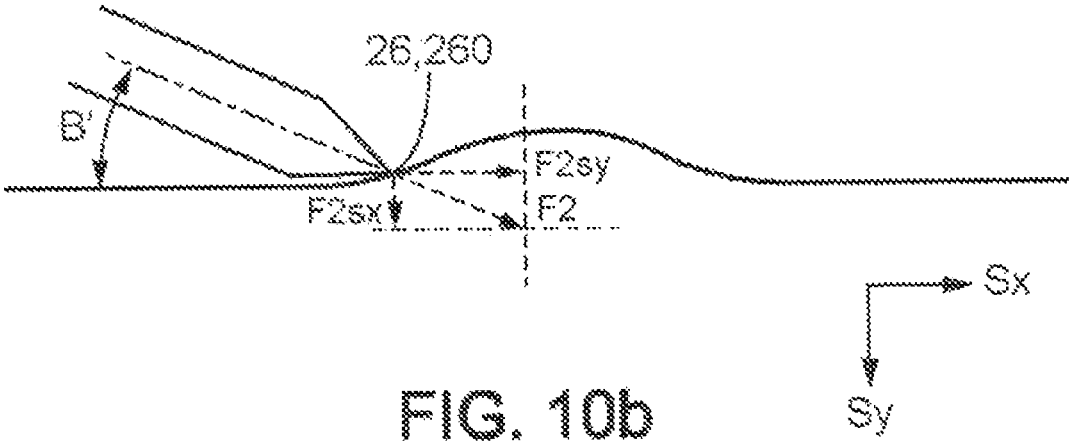

The angle ranges aforementioned decrease the irritation of the skin. FIG. 10*a* represents the cutting edge portion of a blade with a nominal angle above 30°, whereas FIG. 10*b* represents the cutting edge portion of a blade with a nominal angle being between 5° and 30°, or 12° and 28, or 12° and 19°, or 12° and 18°. The cutting edge portion exerts a force F1 for a nominal angle above 30°, and F2 for a low nominal angle such as defined on the skin. The forces F1 and F2 have the same module. The forces F1 and F2 create a small wave on the surface of the skin. The wave is responsible for friction during shaving as well as irritation of the skin and decreasing the cutting forces. Therefore, it is important to create a wave of skin as small as possible. Forces F1 and F2 have each a component F1*sx*, F2*sx* along a skin longitudinal direction Sx and a component F1*sy*, F2*sy* along a skin transversal direction Sy. With a low shaving angle, such as represented FIG. 10*b*, the component of the force F2 along the Sy-axis F2*sy* is smaller than the component of the force F1 along the Sy direction F1*sy* (more precisely the module of the force F2*sy* is smaller than the module of the force F1*sy*). Thus, the skin is less constrained along the Sy direction and the wave is "smaller" along the direction Sy.

Figure 9:
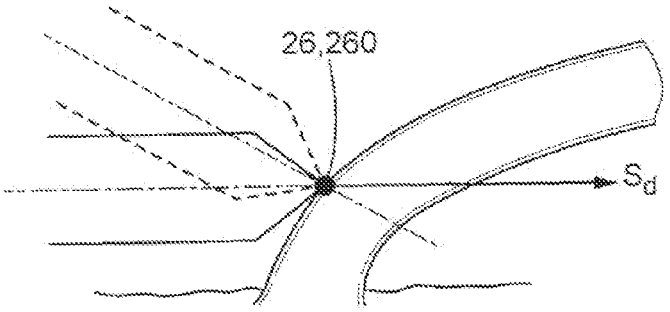
FIG. 9 is a schematic view of a cutting edge of a blade in a razor head according the first or the second embodiment when contacting an hair.

A shaving angle below 5° and more precisely below 12° or 13° for bent blade may cause the user an unacceptable level of discomfort. While shaving, a blade with a shaving angle below 5° for example will push the hair to be cut into a position with regard to the cutting edge of the blade in which a skive-cut occurs (i.e. e blade edge cuts into one side of a hair and, rather than cutting straight across the hair, cuts diagonally through the shaft, leaving one side of the hair longer than another side). By not cutting a hair cleanly, a user may need to shave more frequently, or increase the number of shaving strokes. Therefore the shaving angle of the present invention is advantageous above 5°, and even above 12° for bent blades to avoid such discomfort. FIG. 9 shows such features and represent in dashed points a cutting edge portion having a shaving angle below the afore-mentioned lower limit (i.e. 5°) and in unbroken curve a cutting edge portion having a shaving angle above the afore-mentioned lower limit (i.e. 5°).

A bent blade is shown on FIGS. 2*a*, 2*b* and 3. Below, some geometrical characteristics of the blade are given. The geometrical characteristics of the blade are here nominal characteristics, which do not take into account the actual geometry of the blade due to the manufacturing process or dispersion. In particular, due to the manufacturing process, thickness variations and/or bow, sweep, camber of some blade portions are possible, and are even intrinsic to the product.

Following parameters are defined:

t: thickness of the blade;

L: length of the blade from one lateral side 33 to another 33';

H: height of the blade, measured along direction Y, from the rear edge 54 to the cutting edge 26;

D: cantilever dimension, measured along direction Z, from the cutting edge 26 to the plane of the base portion (X-Y);

α: included angle, measured between the base portion plane and the cutting edge portion plane;

Hb: height of the blade base portion, measured along direction Y, from the rear edge 54 to the bent portion 53;

R: radius of curvature of the inner face of the bent portion;

Hc: Extent of the cutting edge portion, measured along direction U, from the cutting edge 26 to the bent portion 53;

T: period of the serrated edge;

T1: extent of the protrusion of the serration;

h: height of the serrated end.

According to the first embodiment, a suitable razor blade shows the following geometric properties:

| Parameter | Nominal value | Dispersion |
|---|---|---|
| T | 0.1 mm | |
| L | 37.1 mm | |
| H | 2.33 mm | |
| D | 1.35 mm | +/−0.05 mm |
| A | 108° | +/−2° |
| Hb | 1.43 mm | |
| R | 0.6 mm | |
| Hc | 0.28-1.14 mm | |
| T | 5.3 mm | ±0.003 mm |
| h | 0.13-0.32 mm | |
| T1 | 2 mm | |

This value indicated for Hc is in fact an average between the value measured for Hc on both lateral sides of the blade. Due to the deformation of the blade, these two values were different, amounting in average to 0.81 mm and 0.85 mm, respectively. Hc might extend between 0.28 and 1.14 mm, preferably between 0.4 and 1 mm.

Other embodiments were successfully manufactured, which showed satisfactory. For example, parameters like $\alpha$=112°, H=2.4 mm, Hc=0.96 mm show satisfactory.

Advantageously the cantilever dimension D is smaller than the distance between two adjacent cutting edges.

In a second embodiment, and such as represented FIGS. 6, 7*a*, 7*b* and 7*c* of the drawings, each cutting member 24 comprises a blade which defines a cutting edge portion and a blade support 600. Each blade may be formed from a steel strip. The cutting members are L-shaped. Such cutting members are commonly called supported blades. The frame 10 (see FIG. 1 on which the bent blades may be replaced by blade on blade supports) defines a tangent plane (or shaving plane) which corresponds to the plane tangential to the skin contacting surfaces of the frame behind and at front of the cutting edges. The cutting edge of the blades extends below the tangent plane. In other words, the blades have a positive exposure. In another variant the blades or one of the blades may have a negative exposure or a zero exposure.

Each blade and blade support extend longitudinally, parallel to the pivot axis X. Similar features than those described above with regard to the first embodiment may be used in the second embodiment, for example blade material, or dimensions.

As previously noted, the razor blade has a cutting edge 260, and an opposed rear edge 261. The cutting edge 260 is oriented forward in the direction of the shaving. The cutting edge 260 is accessible through the shaving window of the blade receiving section 13, to cut hair. Each blade has an outer face 270 oriented toward the skin to be shaved and an opposed inner face 280. The outer and inner faces 270, 280 of the blade include respectively two parallel main surfaces and two tapered facets which taper toward the cutting edge 260. The two tapered facets form an edge angle, and the bisecting line of the edge angle is the cutting edge portion axis.

As previously the, each razor blade is fixed to a blade support 600. The blade support 600 includes:

- a substantially flat base portion 350 (for example substantially perpendicular to the tangent plane (also called shaving plane)),
- a substantially flat holder portion 390,
- a bent portion 530 extending between the base portion and the holder portion. The bent portion has a concave face and an opposed convex face.

When the cutting member is mounted to slide in the head, the base portion 350 is also sometimes called "guided portion".

The frame 10 defines a tangent plane which corresponds to the plane tangential to the skin contacting surfaces of the frame behind and at front of the cutting edges.

Figure 6:
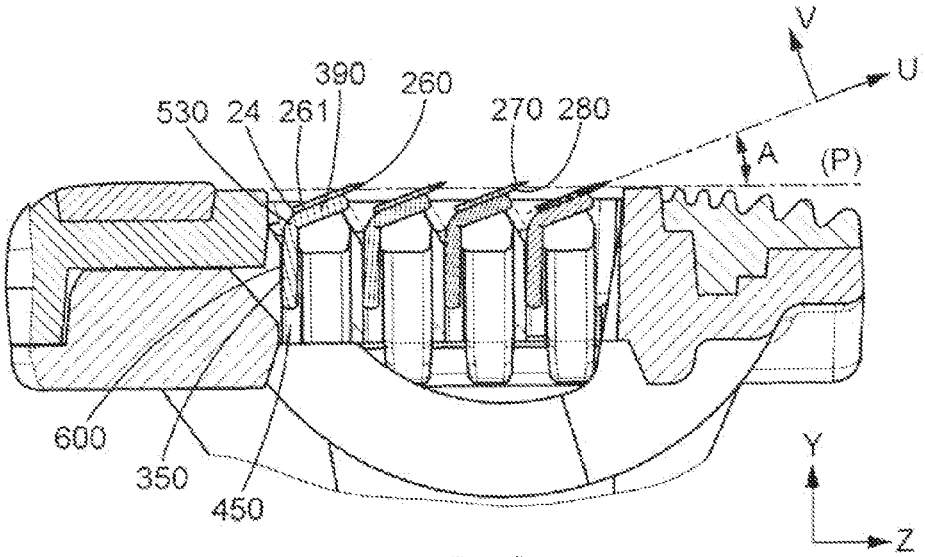
FIG. 6 is a schematic sectional view along line VII-VII on FIG. 1 of a razor head according to a second embodiment.

Each cutting member 24 is borne by two elastic fingers which are molded as a single piece with the platform of the frame and which extend towards each other and upwardly from both side members 15 of the platform. For example, all the fingers extending from a given side member are identical. Besides, as shown in FIG. 6, the base portions 350 of the cutting members are slidingly guided in slots 450 provided in the inner face of each side member of the platform. The slots 450 are, for example, substantially perpendicular to the shaving plane.

The cutting members 24 are elastically biased by the elastic fingers toward a nominal position. More precisely, the blade supports 600 are elastically biased by elastic fingers toward a nominal position. In this nominal position, the outer faces 270 of the cutting member, and more precisely the cutting edge portion, at each lateral end of the cutting member, bear against corresponding upper stop portions which are for example provided on the bottom stopping face of each side member of the cover, the side member covering the slots 450. In the nominal position an angle (also called shaving angle) may be measured between the cutting edge axis and the tangent plane defined by the front guard and the rear cap above-mentioned.

For movable supported blades of the type described above, a shaving angle of between 5° and 30° seemed to provide good results. Better results are expected for a shaving angle between 5° and 20°, and notably between 5° and 18°.

Since the cutting edge portion axis of all cutting member are positioned parallel to each other, the angle between the cutting edge axis and the tangent plane is the same for all blades.

The guiding slots 450 define a direction Y for the razor head. The direction Z is the normal to the X-Y plane. The base portion 350 extends in a base portion plane. The base portion axis is the main axis of the base portion other than its profile axis, i.e. other than the X axis. In the present embodiment, it is the Y axis. In other words, the main axis along which the base portion extends is the same as the axis defined by the slots 450 in the razor head.

The blade (or cutting edge portion) 390 extends in a cutting edge portion plane. The cutting edge portion axis is the main axis of the cutting edge portion other than its profile axis, i.e. other than the X axis. In the present embodiment, it is a U axis. In other words, the cutting edge portion axis extends in an X-U plane. A V axis is defined normal to the X-U plane.

Figure 8A:
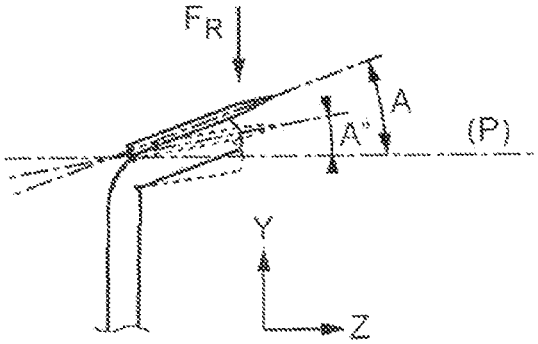
FIGS. 8*a* and 8*b* are schematic views of a blade of the razor head of FIG. 6 in different positions.

To achieve the shaving, the user has to make the razor head into contact with his skin. As shown on FIG. 8*a*, the angle A" measured between the cutting edge axis and the tangent plane when the razor head is contacting the skin of the user and before any movement is different than the angle A measured between the cutting edge axis and the tangent plane in the nominal position. Indeed, a force Fr will be applied to the cutting member by the user, along a direction (see FIG. 8*a*) which is sensibly normal to the tangent plane P (In other words, the force F is applied sensibly in the Y direction at approximately ±5°) to achieve the contact between the skin and the cutting members.

Figure 8B:
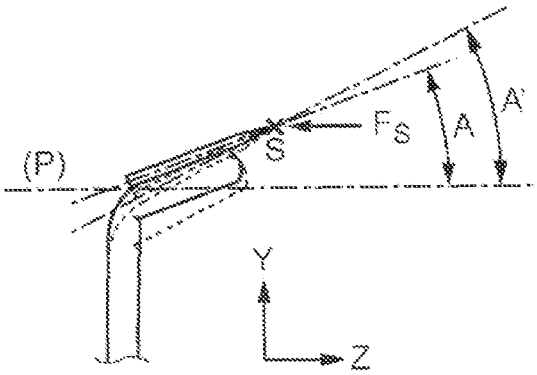

Moreover, upon shaving and such as represented on FIG. 8*b* a force Fs will be applied to the cutting member, along a direction F which is sensibly parallel to the tangent plane P. The cutting members are movable in translation inside the slots 450 and are therefore guided for movement in a direction perpendicular to the tangent plane. The shape of the supported blades and their placement inside a slot 450 allows a degree of rotational movement of the blades with regard to the frame of the razor head. In other words, the whole blade rotates in the slot when there is force acting on the hair during hair or skin contact. The rotation tends to increase the shaving angle.

Moreover, the shape of the bent blades and their placement inside the slot 450 allows also a deflection movement of the blade with regard to the guided portion, such as shown on FIG. 8*b*. More precisely, under a force applied along the direction Fs, the elastic fingers retract into slot 450 and lead the blades, and more precisely the guided portion in a movement of translation toward the bottom of the frame 10. At the same time, the bent portion of the blade support moves and the angle between the holder portion and the guided portion increase. Since the force applied to the cutting member is different in a position when the head contact the skin without moving (also called rest-position) and a movable position during shaving (also called shaving position), the rotation of the cutting edge portion is different, and therefore also the angle.

In the shaving position, the rotation increases the nominal shaving angle such as shown FIG. 8*b*. The shaving angle affects the blade deflection that can be driven by the shaving forces.

On FIG. 8*b*, the S point represents the contact point between the skin and the cutting edge. A cutting member is represented with a full line and corresponds to the cutting member in the nominal position whereas the cutting member with dashed points represents the cutting member in the shaving position. In the nominal position, the angle A between the cutting edge axis and the tangent plane P is lower than the angle A' between the cutting edge axis and the tangent plane P in the shaving position. A direct relation exists between the angle A in the nominal position and the angle A' in the shaving position which depends on the force exerted by the user and on the elasticity degree of the elastic fingers. Therefore, a low shaving angle in the nominal position allows a low shaving angle in the rest and shaving positions which permits optimal shaving performances as described below. According to tests the optimal shaving angle depends on the shape of the blade and is, for supported blades on a bent support between 5° and 30°, and more precisely between 5° and 20°, or between 5° and 18°, as previously the. A shaving angle below 20, and preferably below 18 or 15 degrees is preferred in order to minimize the lost cutting force due to blade deflection.

As aforementioned, a low shaving angle in the range above-described allows a better blade edge penetration and usage convenience. In the FIG. 9 in dashed point is represented the cutting edge portion of a blade with a shaving angle being over 30°. The continuous line in FIG. 9 represents the cutting edge portion of a blade with a shaving angle being under 30°. The cutting edge portion of a blade with a shaving angle being under 30° comes in contact to the hair sensibly parallel to the skin. The hair cutting action is mainly performed by the cutting edge, i.e. the sharpest point of the blade. The resistance to cutting is therefore lower which means a better usage convenience for the user.

The aforementioned angle ranges decrease the irritation of the skin. FIG. 10*a* represents the cutting edge portion of a blade with a nominal angle above 30°, whereas FIG. 10*b* represents the cutting edge portion of a blade with a nominal angle being between 5° and 30°, or 5° and 20°, or 5° and 18°. The cutting edge portion exerts a force F1 for a nominal angle above 30°, and F2 for a low nominal angle such as defined on the skin. The forces F1 and F2 have the same module. The forces F1 and F2 create a small wave on the surface of the skin. The wave produces friction during shaving as well as irritation of the skin and decrease the cutting forces. Therefore, it is important to create a wave of skin as small as possible. Forces F1 and F2 have each a component F1*sx*, F2*sx* along a skin longitudinal direction Sx and a component F1*sy*, F2*sy* along a skin transversal direction Sy. With a low shaving angle, such as represented FIG. 10*b*, the component of the force F2 along the Y direction F2*sy* is smaller than the component of the force F1 along the Sy direction F1*sy*. Thus, the skin is less constrained along the Y-axis direction and the wave is "smaller" along the direction Sy.

A shaving angle below 5° may cause the user an unacceptable level of discomfort. While shaving, a blade with a shaving angle below 5° for example will push the hair to be cut into a position with regard to the cutting edge of the blade in which a skive-cut occurs (i.e. e blade edge cuts into one side of a hair and, rather than cutting straight across the hair, cuts diagonally through the shaft, leaving one side of the hair longer than another side). By not cutting a hair cleanly, a user may need to shave more frequently, or increase the number of shaving strokes. Therefore the shaving angle of the present invention is advantageous above 5° to avoid such discomfort. FIG. 9 shows such features and represent in dashed points a cutting edge portion having a shaving angle below the afore-mentioned lower limit (i.e. 5°) and in unbroken curve a cutting edge portion having a shaving angle above the afore-mentioned lower limit (i.e. 5°).

With a shaving angle below 5° there is also a possibility of hydroplaning effect. Indeed, since the hair has a degree of elasticity, if the blade lies very close to being parallel to the skin it can press the hair downwards passing over it without any engagement and no cutting action, reducing shaving efficiency.

Figure 7A:
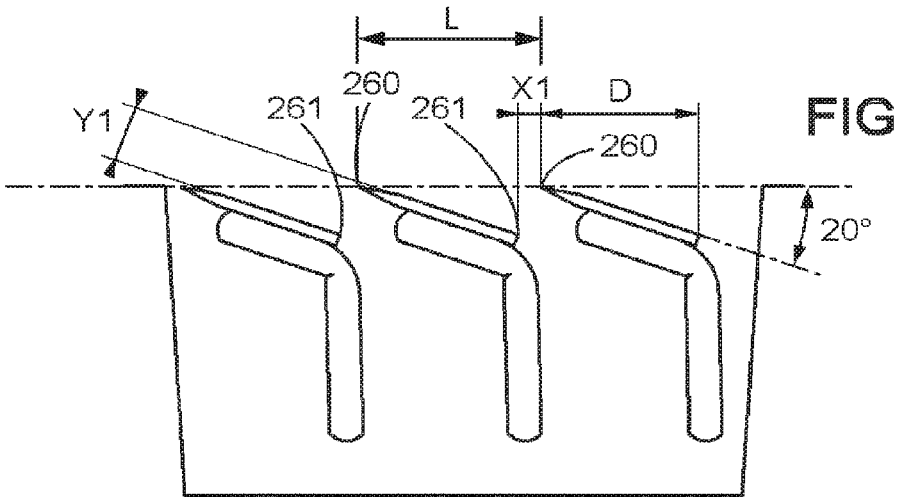
FIGS. 7*a*, 7*b* and 7*c* are schematic views of blades of a razor blade according to a variant of the second embodiment.
Figure 7B:
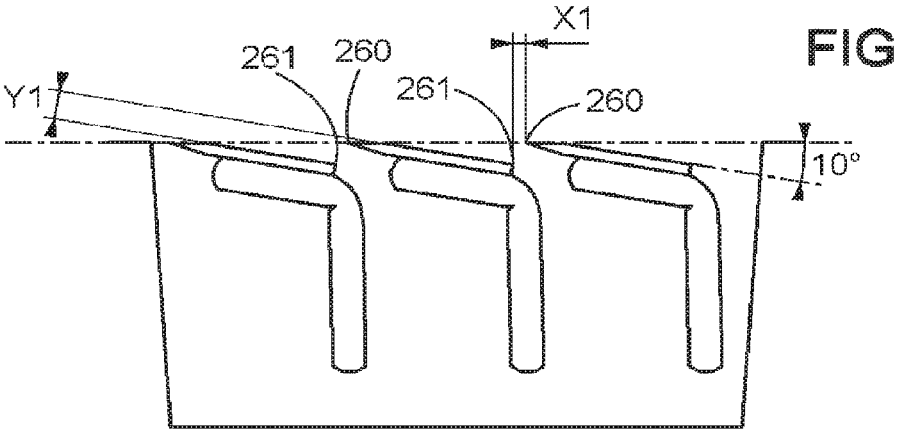
Figure 7C:
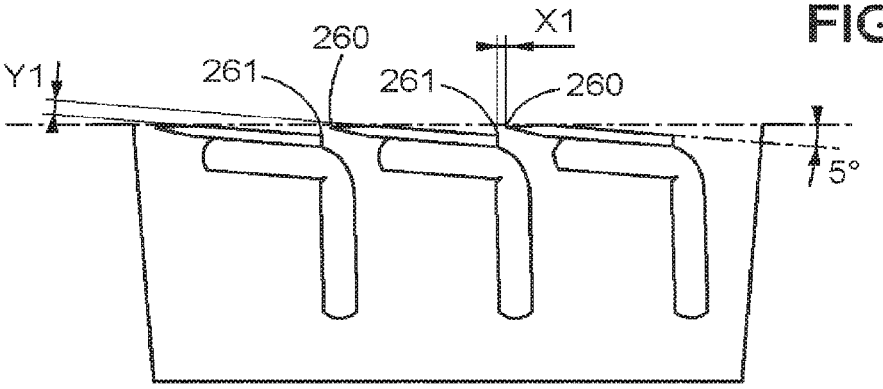

Such as shown FIGS. 7*a*, 7*b* and 7*c* the blades are in series one after the other. In order to not affect the rinsing, low shaving angles of the blades have to be combined with specific dimensions of the razor head. FIG. 6*a* shows three blades having a shaving angle of 20° whereas FIG. 6*b* shows three blades having a shaving angle of 10°, and FIG. 6*c* three blades having a shaving angle of 5°. A passage for through flow of rinsing water is provided and allows effective removal of soap and shaving debris, for example from the underside of the blade. The passage for through flow of rinsing water connects a gap between a cutting edge 260 of a first blade and the opposed rear edge 261 of an adjacent blade.

Following parameters are defined:

- X1: thickness of the passage for through flow measured along direction Z from the cutting edge 260 to the opposed rear edge 261 of the adjacent blade;
- Y1: length of the passage for through flow measured between two cutting edge portion axis of two adjacent blades;
- D: cantilever dimension, measured along direction Z from the cutting edge 260 to the opposed rear edge 261 of the blade;
- L: blade spacing, measured along direction Z from the cutting edge 260 of a blade, to the cutting edge of the adjacent blade.

Dimensions Y1 and X1 form the main windows of through flow passage. The windows can be significantly reduced when the shaving angle is small, as shown FIG. 6*c* with regard to FIGS. 6*a* and 6*b*. Indeed, as long as the D dimension of the blade is equal or inferior to the L dimension, tests have shown that an acceptable water flow through passage is achieved.

In the present description, features used for the first embodiment may also be used for the second embodiment, and vice versa. For example, the dimensions disclosed for bent blades may also be used for supported blades.

The invention claimed is:

1. A razor head comprising:

a housing having a top face defining a shaving window delimited by a front guard and a rear cap, together defining a tangent plane, at least one rigid cutting member each movably mounted in a blade-receiving section of the housing, and having:

a cutting edge portion extending along a cutting edge portion axis, and having a cutting edge accessible through the shaving window, a guided portion extending along a guided portion axis, and a bent portion intermediate the cutting edge portion and the guided portion, wherein each cutting member is an integrally formed rigid blade comprising the cutting edge portion, the guided portion extending along the guided portion axis, and the bent portion intermediate the cutting edge portion and the guided portion, wherein an angle measured between the cutting edge axis and the tangent plane is between approximately 12° and 18°, wherein the housing has a guide, wherein the cutting members are guided for movement in the guide from a nominal position achieved when not shaving, wherein the angle measured between the cutting edge axis and the tangent plane is measured in the nominal position.

2. The razor head according to claim 1, wherein the cutting members are guided for movement in a direction perpendicular to the tangent plane.

3. The razor head according to claim 2, wherein the guided portion of the cutting members cooperates with the guide so that each cutting member is independently translatable with respect to the housing along a sliding direction parallel to the guided portion axis, under the effect of shaving forces applied to the blade during shaving.

4. The razor head according to claim 1, wherein the guided portion has a plane shape, the cantilever dimension, measured from the cutting edge to the plane of the guided portion along the direction of the tangent plane, is smaller than the distance between two adjacent cutting edges measured along the direction of the tangent plane to allow water flow through the razor head.

5. The razor head according to claim 1, wherein each cutting member has an exposure greater than zero.

6. The razor head according to claim 1, wherein the blade includes at least two parallel main surfaces and at least two tapered facets which taper towards the cutting edge forming an edge angle, and wherein the bisecting line of the edge angle is the cutting edge portion axis.

7. The razor head according to claim 1, wherein each angle between the cutting edge axis and the tangent plane is the same.

8. A razor head comprising:

a housing having a top face defining a shaving window delimited by a front guard and a rear cap, together defining a tangent plane, at least one rigid cutting member each movably mounted in a blade-receiving section of the housing, and having:

a cutting edge portion coupled with a holder portion, the cutting edge portion extending along a cutting edge portion axis, and having a cutting edge accessible through the shaving window, a guided portion extending along a guided portion axis, and a bent portion intermediate the cutting edge portion and the guided portion, wherein each cutting member comprises a blade which defines the cutting edge portion, and a blade support, the blade support comprising the guided portion, the bent portion, and the holder portion, wherein an angle measured between the cutting edge axis and the tangent plane is between 5° and 18°, wherein the housing has a guide, wherein the cutting members are guided for movement in the guide from a nominal position achieved when not shaving, wherein the angle measured between the cutting edge axis and the tangent plane is measured in the nominal position.

9. The razor head according to claim 8, wherein the bent portion is intermediate the holder portion and the guided portion.

10. The razor head according to claim 8, wherein the blade is rigidly fixed to the holder portion of the blade support and the blade extends beyond the holder portion along the cutting edge portion axis.

11. The razor head according to claim 8, wherein the cutting members are guided for movement in a direction perpendicular to the tangent plane.

12. The razor head according to claim 11, wherein the guided portion of the cutting members cooperates with the guide so that each cutting member is independently translatable with respect to the housing along a sliding direction parallel to the guided portion axis, under the effect of shaving forces applied to the blade during shaving.

13. The razor head according to claim 8, wherein the guided portion has a plane shape, the cantilever dimension, measured from the cutting edge to the plane of the guided portion along the direction of the tangent plane, is smaller than the distance between two adjacent cutting edges measured along the direction of the tangent plane to allow water flow through the razor head.

14. The razor head according to claim 8, wherein each cutting member has an exposure greater than zero.

15. The razor head according to claim 8, wherein the blade includes at least two parallel main surfaces and at least two tapered facets which taper towards the cutting edge forming an edge angle, and wherein the bisecting line of the edge angle is the cutting edge portion axis.

16. The razor head according to claim 8, wherein each angle between the cutting edge axis and the tangent plane is the same.

* * * * *